United States Patent [19]

Schultz

[11] Patent Number: 4,658,802

[45] Date of Patent: Apr. 21, 1987

[54] HEATED SEAMING APPARATUS

[75] Inventor: William K. Schultz, La Crosse, Kans.

[73] Assignee: Flame Engineering, Inc., La Crosse, Kans.

[21] Appl. No.: 729,720

[22] Filed: May 2, 1985

[51] Int. Cl.[4] ..... F23C 5/00

[52] U.S. Cl. ..... 126/271.2 A; 126/401

[58] Field of Search ..... 101/28; 52/230; 126/401, 402, 403, 404, 405, 406, 407, 410, 411, 412, 414, 230, 227, 228, 226, 236, 271.1 R, 271.2 R, 271.2 A; 403/385, 400; 24/335, 339

[56] References Cited

U.S. PATENT DOCUMENTS

| | | | |
|---|---|---|---|
| 930,010 | 8/1909 | Wise | 126/414 |
| 936,816 | 10/1909 | Schemnitz | 126/414 |
| 1,030,086 | 6/1912 | Hanson | 431/344 |
| 1,297,245 | 3/1919 | Reddicliffe | 126/413 |
| 1,304,795 | 5/1919 | Moscini . | |
| 1,378,675 | 5/1921 | Hauck | 126/401 |
| 1,509,236 | 9/1924 | Greene . | |
| 1,735,212 | 11/1927 | Pawsat | 24/335 X |
| 1,837,030 | 11/1927 | Elze . | |
| 1,916,661 | 1/1932 | Flothow . | |
| 2,310,276 | 2/1943 | Bilz | 403/385 |
| 2,542,525 | 2/1951 | Hogenson | 126/410 |
| 2,692,641 | 10/1954 | Woods | 126/401 |
| 2,833,272 | 5/1958 | Kennepohl | 431/345 X |
| 3,068,765 | 12/1962 | Caufield | 126/410 X |
| 3,143,984 | 8/1964 | Morasch | 37/230 X |
| 3,171,466 | 2/1959 | Katchur, Jr. . | |
| 4,176,657 | 12/1979 | Eriksson et al. | 126/401 |
| 4,364,435 | 12/1982 | Toggle et al. | 56/DIG. 18 X |

FOREIGN PATENT DOCUMENTS

| | | | |
|---|---|---|---|
| 514970 | 11/1939 | United Kingdom | 126/401 |

*Primary Examiner*—Carroll B. Dority, Jr.
*Attorney, Agent, or Firm*—Henderson & Sturm

[57] ABSTRACT

This invention relates to a heated seam sealing apparatus (10) comprising a handle unit (11), a trowel unit (12), a torch unit (13), and a torch control unit (14) wherein the trowel unit (11) may be angularly varied with respect to the handle unit, and both the height, duration, intensity, and angle of the torch flame may be varied with respect to the trowel unit.

1 Claim, 3 Drawing Figures

FIG. 1.
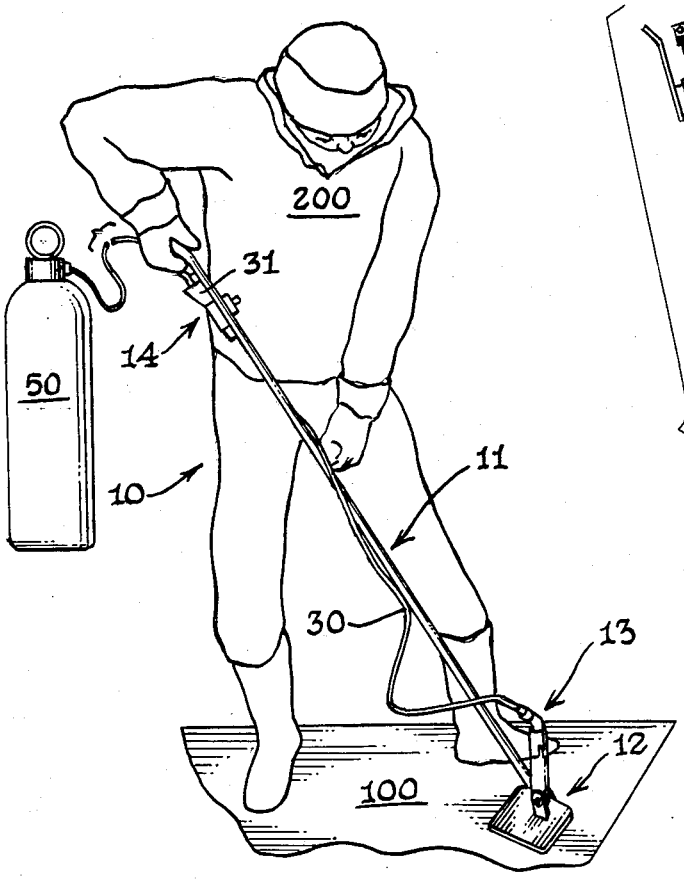
FIG. 2.
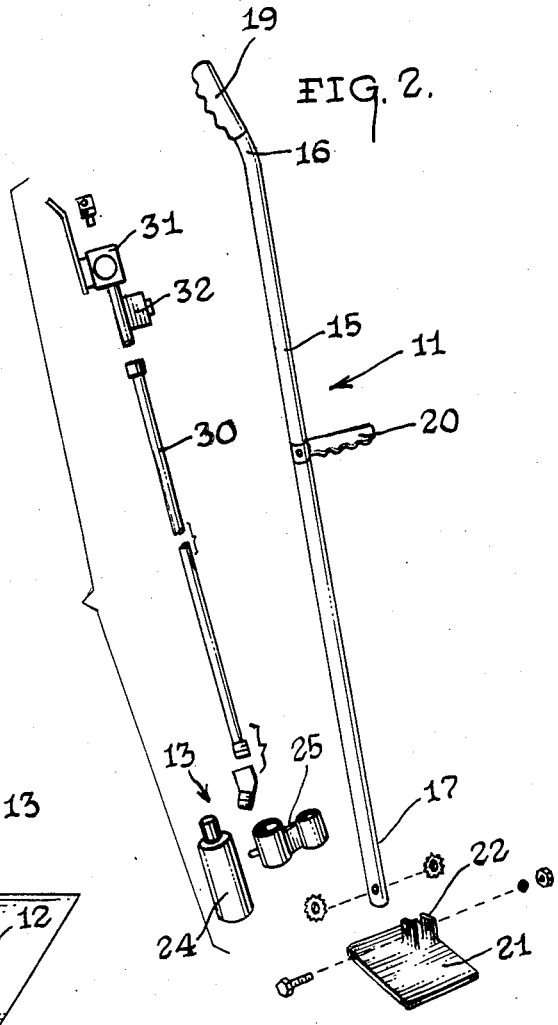
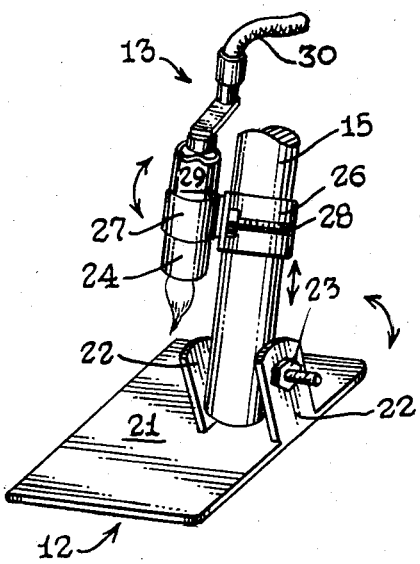
FIG. 3.

HEATED SEAMING APPARATUS

TECHNICAL FIELD

The present invention relates generally to the field of heated trowel implements.

BACKGROUND OF THE INVENTION

As can be seen by reference to U.S. Pat. Nos. 3,171,466; 1,837,030; and 1,509,236, the prior art is replete with heated trowel implements for use on a coated surface. These heated trowel elements all share common structural features on the form of an elongated handle provided with a trowel or trowel like element having a heating element disposed in close proximity to the trowel element.

While the aforementioned prior art devices are all more or less adequate for their intended purposes, they do share a common deficiency in that the structural elements are disposed in a fixed relationship to one another and neither provide for nor allow for a flexibility regarding the relative position of the structural elements nor any degree of immediate operator control to automatically vary the amount of heat that is applied to the trowel surface.

SUMMARY OF THE INVENTION

The present invention involves a heated seaming apparatus comprising an elongated handle unit, an adjustable trowel unit, an adjustable torch unit, and a torch control unit.

As will be explained in greater detail further on in the specification, the trowel unit is relatively moveable with respect to the lower end of the handle unit, and the torch unit is relatively moveable with respect to both the handle unit and the trowel unit. In addition the torch control unit provides instantaneous adjustment of the intensity and duration of the flame that is used to heat the trowel unit surface.

In addition to the above, the heated seaming apparatus of this invention can be used to reheat laps; check for voids or loose areas; heat and reseal voids; and finish off seams.

BRIEF DESCRIPTION OF THE DRAWINGS

These and other objects, advantages and novel features of the invention will become apparent from the detailed description of the best mode for carrying out the invention which follows, particularly when considered in conjunction with the accompanying drawings, wherein:

FIG. 1 is a perspective view of the heated seaming apparatus in use;

FIG. 2 is an exploded view of the apparatus; and,

FIG. 3 is an enlarged detailed view of the heated portion of the apparatus.

BEST MODE FOR CARRYING OUT THE INVENTION

As can be seen by reference to the drawings and in particular to FIG. 1, the heated seaming apparatus of this invention is designated generally by the reference numeral (10) comprises in general a handle unit (11), a trowel unit (12), a torch unit (13), and a torch control unit (14). These units will now be described in seriation fashion.

As can be seen in FIG. 2, the handle unit (11) comprises a main elongated tubular handle member (15) having an angled upper end (16) and an apertured lower end (17). In addition, the handle unit (11) is further provided with an upper handle grip element that fits over the angled upper end (16), and an intermediate relatively short handle element (20) that is disposed at a selected position on the tubular member (15), and projects outwardly therefrom in a generally perpendicular fashion.

The trowel unit (12) comprises a generally flat trowel member (21) having an off-set pair of apertured ears (22) projecting upwardly therefrom. As shown in FIGS. 2 and 3 the trowel unit (12) is pivotally attached to the lower end (17) of the handle unit (11) via a releasable securing means (23); which is adapted to retain the trowel member (21) at a variety of selected angular dispositions with respect to the axis of the handle unit (11).

The torch unit (13) comprises in general a torch member (24) and a torch holder (25). The torch holder (25) comprises a pair of relatively rotatable adjustable collar elements (26) and (27) that are adapted to releasably engage the torch member (24) and the elongated main handle member (15) in a variety of angular dispositions with respect to one another, and also to position the torch holder (25) and torch member (24) at a selected distance from the trowel member (21). Both of the adjustable collar elements (26) and (27) are further provided with releasable locking means (28) that may be actuated to retain the respective collar elements in any position relative to one another and also with respect to the torch member (24) and the elongated tubular member (15).

The torch member (24) comprises a pilot operated burner element (29) operatively connected to a remote pressure regulated fuel source (50) via a flexible fuel supply line (30) having the torch control unit (14) interposed therein.

The torch control unit (14) is disposed intermediate the regulated fuel source (50) and the torch member (24), and is operatively connected to the upper portion of the tubular member (15) proximate the angled end (16). The torch control unit (14) comprises a lever actuated valve assembly (31) provided with an adjustable collar element (32) for selectively positioning the torch control unit (14) on the handle unit (11). The lever control actuated valve assembly (31) controls both the duration and supply of fuel from the regulated fuel source (50) to the pilot operated burner (29) in a well recognized manner.

Once the apparatus (10) has been hooked up to the fuel source (50) and the pilot light (not shown) of the pilot operated burner (29) has been ignited; the apparatus would be used to seam overlapped or abutted edges of modified bitumin by the simultaneous and/or sequential application of heat and pressure via the heated trowel member surface (21).

By virtue of the arrangement and structural relationship of the apparatus herein described the trowel unit (12) may be angularly adjusted with respect to the work surface (100) or the handle unit (11), and both the height, angle, intensity, and duration of the burner flame with respect to the trowel member (21) may be varied according to the desires of the operator (200), with the intensity and duration of the flame being under virtually instantaneous fingertip control.

Having thereby described the subject matter of this invention it should be fairly obvious that many substitutions, modifications and variations of the apparatus are possible in light of the above teachings. It is therefore to be understood that the invention as taught and described herein is only to be limited to the extent of the breadth and scope of the appended claims.

I claim:

1. A heated seam sealing apparatus wherein the apparatus consists of:

a handle unit comprising an elongated main handle member having an angled upper end which is provide with a handle grip element; and, a relatively short intermediate handle element that projects outwardly from said main handle member;

a trowel unit comprising a generally flat trowel member pivotally secured to the lower end of the main handle member, and provided with releasable securing means for retaining the trowel member in a variety of angular dispositions with respect to the main handle member;

a torch unit comprising a torch member and an adjustable torch holder wherein the torch member may be angularly disposed with respect to the said trowel member and wherein said adjustable torch holder comprises a pair of relatively rotatable adjustable collar elements, which are adapted to releasably engage the torch member and the main handle member in a variety of angular dispositions with respect to another, and also to vary the height of the torch unit on the main handle member with respect to the trowel unit; and, a torch control unit attached to the main handle member and interposed between the torch unit and a source of fuel wherein the torch control unit comprises a lever actuated valve assembly which controls the supply of fuel from the fuel source to the torch member via a flexible fuel supply line; whereby, the height, angle, intensity, and duration of the burner flame with respect to the trowel member may be selectively varied by a user of the apparatus.

* * * * *